US008118371B2

(12) United States Patent
Hall et al.

(10) Patent No.: US 8,118,371 B2
(45) Date of Patent: Feb. 21, 2012

(54) RESILIENT PICK SHANK

(75) Inventors: David R. Hall, Provo, UT (US); Jeff Jepson, Spanish Fork, UT (US); Gary Peterson, Salem, UT (US)

(73) Assignee: Schlumberger Technology Corporation, Houston, TX (US)

( * ) Notice: Subject to any disclaimer, the term of this patent is extended or adjusted under 35 U.S.C. 154(b) by 271 days.

(21) Appl. No.: 12/491,848

(22) Filed: Jun. 25, 2009

(65) Prior Publication Data

US 2009/0273225 A1 Nov. 5, 2009

Related U.S. Application Data

(63) Continuation-in-part of application No. 11/962,497, filed on Dec. 21, 2007, and a continuation-in-part of application No. 12/177,556, filed on Jul. 22, 2008, now Pat. No. 7,635,168, which is a continuation-in-part of application No. 12/135,595, filed on Jun. 9, 2008, now Pat. No. 7,946,656, which is a continuation-in-part of application No. 12/112,743, filed on Apr. 30, 2008, now Pat. No. 8,029,068, which is a continuation-in-part of application No. 12/051,738, filed on Mar. 19, 2008, now Pat. No. 7,669,674, which is a continuation-in-part of application No. 12/051,689, filed on Mar. 19, 2008, now Pat. No. 7,963,617, which is a continuation of application No. 12/051,586, filed on Mar. 19, 2008, now Pat. No. 8,007,050, which is a continuation-in-part of application No. 12/021,051, filed on Jan. 28, 2008, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, now Pat. No. 8,007,051, which is a (Continued)

(51) Int. Cl.
*E21C 35/197* (2006.01)

(52) U.S. Cl. ..... 299/102; 299/103

(58) Field of Classification Search ..... 299/104, 299/102, 103
See application file for complete search history.

(56) References Cited

U.S. PATENT DOCUMENTS 2,004,315 A 6/1935 Fean (Continued)

FOREIGN PATENT DOCUMENTS

DE 3 307 910 9/1984

(Continued)

*Primary Examiner* — John Kreck
(74) *Attorney, Agent, or Firm* — Brinks Hofer Gilson & Lione

(57) ABSTRACT

In one aspect of the invention, a pick assembly comprises a pick shank press fitted within a bore of a pick holder. The pick comprises a pick head opposite the shank. The shank also comprises at least one longitudinal slot extending towards the pick head along the shank from a distal end of the shank. The slot allows the shank to resiliently collapse upon insertion into the bore while still allowing the shank to maintain a press fit while within the bore.

20 Claims, 13 Drawing Sheets

Related U.S. Application Data continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, application No. 12/491,848, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(56) References Cited

U.S. PATENT DOCUMENTS

| | | | | |
|---|---|---|---|---|
| 2,124,438 | A | | 7/1938 | Struk et al. |
| 3,254,392 | A | | 6/1966 | Novkov |
| 3,336,081 | A | | 8/1967 | Ericsson |
| 3,342,532 | A | | 9/1967 | Krekeler |
| 3,746,396 | A | | 7/1973 | Radd |
| 3,801,158 | A | | 4/1974 | Radd et al. |
| 3,807,804 | A | | 4/1974 | Kniff |
| 3,830,321 | A | | 8/1974 | McKenry et al. |
| 3,865,437 | A | * | 2/1975 | Crosby ..... 299/107 |
| 3,932,952 | A | | 1/1976 | Helton |
| 3,942,838 | A | | 3/1976 | Bailey et al. |
| 3,945,681 | A | | 3/1976 | White |
| 4,005,914 | A | | 2/1977 | Newman |
| 4,006,936 | A | | 2/1977 | Crabiel |
| 4,084,856 | A | * | 4/1978 | Emmerich et al. ..... 299/104 |
| 4,098,362 | A | | 7/1978 | Bonnice |
| 4,109,737 | A | | 8/1978 | Bovenkerk |
| 4,156,329 | A | | 5/1979 | Daniels et al. |
| 4,199,035 | A | | 4/1980 | Thompson |
| 4,201,421 | A | | 5/1980 | Besten |
| 4,251,109 | A | | 2/1981 | Roepke |
| 4,277,106 | A | | 7/1981 | Sahley |
| 4,439,250 | A | | 3/1984 | Acharya et al. |
| 4,465,221 | A | | 8/1984 | Schmidt |
| 4,484,644 | A | | 11/1984 | Cook et al. |
| 4,489,986 | A | | 12/1984 | Dziak |
| 4,669,786 | A | | 6/1987 | Morgan et al. |
| 4,678,237 | A | | 7/1987 | Collin |
| 4,682,987 | A | | 7/1987 | Brady et al. |
| 4,688,856 | A | | 8/1987 | Elfgen |
| 4,725,098 | A | | 2/1988 | Beach |
| 4,729,603 | A | | 3/1988 | Elfgen |
| 4,765,686 | A | | 8/1988 | Adams |
| 4,765,687 | A | | 8/1988 | Parrott |
| 4,776,862 | A | | 10/1988 | Wiand |
| 4,880,154 | A | | 11/1989 | Tank |
| 4,932,723 | A | | 6/1990 | Mills |
| 4,940,288 | A | | 7/1990 | Stiffler et al. |
| 4,944,559 | A | | 7/1990 | Sionnet et al. |
| 4,951,762 | A | | 8/1990 | Lundell |
| 4,956,238 | A | | 9/1990 | Griffin |
| 5,011,515 | A | | 4/1991 | Frushour |
| 5,112,165 | A | | 5/1992 | Hedlund et al. |
| 5,119,714 | A | | 6/1992 | Scott et al. |
| 5,141,289 | A | | 8/1992 | Stiffler |
| 5,154,245 | A | | 10/1992 | Waldenstrom |
| 5,186,892 | A | | 2/1993 | Pope |
| 5,251,964 | A | | 10/1993 | Ojanen |
| 5,261,499 | A | | 11/1993 | Grubb |
| 5,332,348 | A | | 7/1994 | Lemelson |
| 5,417,475 | A | | 5/1995 | Graham et al. |
| 5,447,208 | A | | 9/1995 | Lund |
| 5,535,839 | A | | 7/1996 | Brady |
| 5,542,993 | A | | 8/1996 | Rabinkin |
| 5,653,300 | A | | 8/1997 | Lund |
| 5,738,698 | A | | 4/1998 | Kapoor et al. |
| 5,823,632 | A | | 10/1998 | Burkett |
| 5,837,071 | A | | 11/1998 | Andersson et al. |
| 5,845,547 | A | | 12/1998 | Sollami |
| 5,875,862 | A | | 3/1999 | Jurewicz |
| 5,890,552 | A | | 4/1999 | Scott et al. |
| 5,934,542 | A | | 8/1999 | Nakamura et al. |
| 5,935,718 | A | | 8/1999 | Demo et al. |
| 5,944,129 | A | | 8/1999 | Jensen |
| 5,967,250 | A | | 10/1999 | Lund |
| 5,992,405 | A | | 11/1999 | Sollami |
| 6,006,846 | A | | 12/1999 | Tibbitts et al. |
| 6,019,434 | A | | 2/2000 | Emmerich |
| 6,044,920 | A | | 4/2000 | Massa et al. |
| 6,051,079 | A | | 4/2000 | Andersson et al. |
| 6,056,911 | A | | 5/2000 | Griffin |
| 6,059,373 | A | * | 5/2000 | Wright et al. ..... 299/104 |
| 6,065,552 | A | | 5/2000 | Scott et al. |
| 6,099,081 | A | | 8/2000 | Warren et al. |
| 6,102,486 | A | | 8/2000 | Briese |
| 6,113,195 | A | | 9/2000 | Mercier et al. |
| 6,170,917 | B1 | | 1/2001 | Heinrich et al. |
| 6,193,770 | B1 | | 2/2001 | Sung |
| 6,196,636 | B1 | | 3/2001 | Mills |
| 6,196,910 | B1 | | 3/2001 | Johnson |
| 6,199,956 | B1 | | 3/2001 | Kammerer |
| 6,216,805 | B1 | | 4/2001 | Lays et al. |
| 6,270,165 | B1 | | 8/2001 | Peay |
| 6,331,035 | B1 | * | 12/2001 | Montgomery, Jr. ..... 299/106 |
| 6,341,823 | B1 | | 1/2002 | Sollami |
| 6,354,771 | B1 | | 3/2002 | Bauschulte et al. |
| 6,364,420 | B1 | | 4/2002 | Sollami |
| 6,371,567 | B1 | | 4/2002 | Sollami |
| 6,375,272 | B1 | | 4/2002 | Ojanen |
| 6,419,278 | B1 | | 7/2002 | Cunningham |
| 6,478,383 | B1 | | 11/2002 | Ojanen et al. |
| 6,499,547 | B2 | | 12/2002 | Scott et al. |
| 6,517,902 | B2 | | 2/2003 | Drake et al. |
| 6,585,326 | B2 | | 7/2003 | Sollami |
| 6,672,406 | B2 | | 1/2004 | Beuershausen |
| 6,685,273 | B1 | | 2/2004 | Sollami |
| 6,692,083 | B2 | | 2/2004 | Latham |
| 6,709,065 | B2 | | 3/2004 | Peay et al. |
| 6,719,074 | B2 | | 4/2004 | Tsuda et al. |
| 6,733,087 | B2 | | 5/2004 | Hall et al. |
| 6,739,327 | B2 | | 5/2004 | Sollami |
| 6,758,530 | B2 | | 7/2004 | Sollami |
| 6,786,557 | B2 | | 9/2004 | Montgomery, Jr. |
| 6,824,225 | B2 | | 11/2004 | Stiffler |
| 6,846,045 | B2 | | 1/2005 | Sollami |
| 6,851,758 | B2 | | 2/2005 | Beach |
| 6,854,810 | B2 | * | 2/2005 | Montgomery, Jr. ..... 299/106 |
| 6,861,137 | B2 | | 3/2005 | Griffin et al. |
| 6,889,890 | B2 | | 5/2005 | Yamazaki et al. |
| 6,938,961 | B2 | | 9/2005 | Broom |
| 6,966,611 | B1 | | 11/2005 | Sollami |
| 6,994,404 | B1 | | 2/2006 | Sollami |
| 7,204,560 | B2 | | 4/2007 | Mercier et al. |
| 7,234,782 | B2 | | 6/2007 | Stehney |
| 7,350,601 | B2 | | 4/2008 | Belnap et al. |
| 2002/0175555 | A1 | | 11/2002 | Mercier |
| 2003/0015907 | A1 | | 1/2003 | Sollami |

| | | | | |
|---|---|---|---|---|
| 2003/0052530 | A1 | 3/2003 | Sollami | |
| 2003/0110667 | A1 | 6/2003 | Adachi | |
| 2003/0141350 | A1 | 7/2003 | Noro et al. | |
| 2003/0209366 | A1 | 11/2003 | McAlvain | |
| 2003/0213354 | A1 * | 11/2003 | Frers | 83/821 |
| 2003/0234280 | A1 | 12/2003 | Cadden et al. | |
| 2004/0026983 | A1 | 2/2004 | McAlvain | |
| 2004/0065484 | A1 | 4/2004 | McAlvain | |
| 2005/0035649 | A1 | 2/2005 | Mercier | |
| 2005/0159840 | A1 | 7/2005 | Lin et al. | |
| 2005/0173966 | A1 | 8/2005 | Mouthaan | |
| 2006/0086540 | A1 | 4/2006 | Griffin | |
| 2006/0237236 | A1 | 10/2006 | Sreshta et al. | |
| 2007/0013224 | A1 | 1/2007 | Stehney | |

FOREIGN PATENT DOCUMENTS

| | | |
|---|---|---|
| DE | 3 500 261 | 7/1986 |
| DE | 3 818 213 | 11/1989 |
| DE | 4 039 217 | 6/1992 |
| DE | 19 821 147 | 11/1999 |
| DE | 10 163 717 | 5/2003 |
| EP | 0 295 151 | 6/1988 |
| EP | 0 412 287 | 2/1991 |
| GB | 2 004 315 | 3/1979 |
| GB | 2 037 223 | 7/1980 |
| JP | 5-280273 | 10/1993 |

* cited by examiner

RESILIENT PICK SHANK

CROSS REFERENCE TO RELATED APPLICATIONS

This application is a continuation in part of U.S. patent application Ser. No. 11/962,497 filed on Dec. 21, 2007. This application is also a continuation-in-part of U.S. patent application Ser. No. 12/177,556 filed on Jul. 22, 2008 and which is now U.S. Pat. No. 7,635,168 issued on Dec. 22, 2009, which is a continuation-in-part of U.S. patent application Ser. No. 12/135,595 filed on Jun. 9, 2008 and which is now U.S. Pat. No. 7,946,656 issued on May 24, 2011, which is a continuation-in-part of U.S. patent application Ser. No. 12/112,743 filed on Apr. 30, 2008, now U.S. Pat. No. 8,029,068, which is a continuation-in-part of U.S. patent application Ser. No. 12/051,738 filed on Mar. 19, 2008 and is now U.S. Pat. No. 7,669,674 issued on Mar. 2, 2010, which is a continuation-in-part of U.S. patent application Ser. No. 12/051,689 filed on Mar. 19, 2008 and now U.S. Pat. No. 7,963,617 issued on Jun. 21, 2011, which is a continuation of U.S. patent application Ser. No. 12/051,586 filed on Mar. 19, 2008 now U.S. Pat. No. 8,007,051, which is a continuation-in-part of U.S. patent application Ser. No. 12/021,051 filed on Jan. 28, 2008, which is a continuation-in-part of U.S. patent application Ser. No. 12/021,019 filed on Jan. 28, 2008, which is a continuation-in-part of U.S. patent application Ser. No. 11/971,965 filed on Jan. 10, 2008 and which is now U.S. Pat. No. 7,648,210 issued on Jan. 19, 2010, which is a continuation of U.S. patent application Ser. No. 11/947,644 filed on Nov. 29, 2007, now U.S. Pat. No. 8,007,051, which is a continuation-in-part of U.S. patent application Ser. No. 11/844,586 filed on Aug. 24, 2007 and which is now U.S. Pat. No. 7,600,823 issued on Oct. 13, 2009 which is a continuation-in-part of U.S. patent application Ser. No. 11/829,761 filed on Jul. 27, 2007 and which is now U.S. Pat. No. 7,722,127 issued on May 25, 2010, which is a continuation-in-part of U.S. patent application Ser. No. 11/773,271 filed on Jul. 3, 2007, now U.S. Pat. No. 7,997,661, which is a continuation-in-part of U.S. patent application Ser. No. 11/766,903 filed on Jun. 22, 2007, which is a continuation of U.S. patent application Ser. No. 11/766,865 filed on Jun. 22, 2007, which is a continuation-in-part of U.S. patent application Ser. No. 11/742,304 filed on Apr. 30, 2007 and which is now U.S. Pat. No. 7,475,948 issued on Jan. 13, 2009, which is a continuation of U.S. patent application Ser. No. 11/742,261 filed on Apr. 30, 2007 and which is now U.S. Pat. No. 7,469,971 issued on Dec. 30, 2008, which is a continuation-in-part of U.S. patent application Ser. No. 11/464,008 filed on Aug. 11, 2006 and now U.S. Pat. No. 7,338,135 issued on Mar. 4, 2008, which is a continuation-in-part of U.S. patent application Ser. No. 11/463,998 filed on Aug. 11, 2006 and which is now U.S. Pat. No. 7,384,105 issued on Jun. 10, 2008, which is a continuation-in-part of U.S. patent application Ser. No. 11/463,990 filed on Aug. 11, 2006 and which is now U.S. Pat. No. 7,320,505 issued on Jan. 22, 2008, which is a continuation-in-part of U.S. patent application Ser. No. 11/463,975 filed on Aug. 11, 2006 and which is now U.S. Pat. No. 7,445,294 issued on Nov. 4, 2008, which is a continuation-in-part of U.S. patent application Ser. No. 11/463,962 filed on Aug. 11, 2006 and which is now U.S. Pat. No. 7,413,256 issued on Aug. 19, 2008. The present application is also a continuation-in-part of U.S. patent application Ser. No. 11/695,672 filed on Apr. 3, 2007 and which is now U.S. Pat. No. 7,396,086 issued on Jul. 8, 2008, which is a continuation-in-part of U.S. patent application Ser. No. 11/686,831 filed on Mar. 15, 2007 and which is now U.S. Pat. No. 7,568,770 issued on Aug. 4, 2009. All of these applications are herein incorporated by reference for all that they contain.

BACKGROUND

Formation degradation, such as asphalt milling, mining, or excavating, may result in wear on attack tools. Consequently, many efforts have been made to efficiently remove and replace these tools.

U.S. Pat. No. 6,585,326 to Sollami, which is herein incorporated by reference for all that it contains, discloses a bit holder and a mating bit block having a bit block bore with a slight taper. The bit holder has a tapered shank that includes a second larger diameter tapered distal segment that combines with an axially oriented slot through the side wall of the bit holder shank to allow a substantially larger interference fit between the distal tapered shank segment and the bit block bore than previously known. When inserting the bit holder in the bit block bore, the distal first tapered segment resiliently collapses to allow insertion of that segment into the bit block bore. A second shank tapered portion axially inwardly of the first distal tapered portion. The dual tapered shank allows the insertion of the bit holder in the bit block with an interference fit that provides a secure mounting of the bit holder in the bit block.

U.S. Pat. No. 3,751,115 to Proctor, which is herein incorporated by reference for all that it contains, discloses a combination of a shanked tool and a holder therefore. The holder is formed with a socket for receiving the tool shank and with a resilient latch biased in a direction transverse to the operating direction for engaging in a recess in the side of the tool shank.

U.S. Pat. No. 3,468,553 to Ashby et al., which is herein incorporated by reference for all that it contains, discloses a tool retaining device having a metal locking pin bonded in a groove of a resilient backing member. One end of the backing member is formed with an integral end sealing cap and the other end has a projecting spigot onto which a further end sealing cap is fitted when the device is fitted in a tool holder. In the fitted posit ion, the two sealing caps respectively seal the ends of the device and thereby prevent the ingress of foreign matter.

U.S. Pat. No. 3,865,437 to Crosby, which is herein incorporated by reference for all that it contains, discloses a mining tool in which a pick style bit is rotatably mounted in a bore in a support member and is retained therein by retaining means integrally formed on the bit. The retaining means advantageously takes the form of at least one radial projection on the rear end of the bit shank with the bit shank being slotted to impart radial resilience thereto so the bit can be assembled with the support member and readily disassembled therefrom while being retained therein during work operations. The support member may comprise a support block adapted for being fixed to a driver with a sleeve rotatable in a bore in the block and in turn, rotatably receiving the bit. The sleeve may be slotted axially from the rear end so as to have lateral resilience and be formed with one or more radial projections or protrusions at the rear end so that the sleeve, also, is releasably retained in the block by retaining means integral therewith.

Further examples of degradation tools from the prior art are disclosed in U.S. Pat. No. 2,989,295 to Prox Jr., U.S. Pat. No. 6,397,652 B1 to Sollami, and U.S. Pat. No. 6,685,273 B1 to Sollami, which are all herein incorporated by reference for all they contain.

BRIEF SUMMARY

In one aspect of the invention, a pick assembly comprises a pick shank press fitted within a bore of a pick holder. The pick comprises a pick head opposite the shank. The shank also comprises at least one longitudinal slot extending towards the pick head along the shank from a distal end of the shank. The slot allows the shank to resiliently collapse upon insertion into the bore while still allowing the shank to maintain a press fit while within the bore.

The shank may comprise a tapered portion proximate the pick head. The shank may comprise a reduced outer diameter portion disposed intermediate the tapered portion and the distal end. The slot may extend to a second end of the tapered portion from the distal end of the shank. The tapered portion may comprise a first end attached to the pick head and the second end connected to the reduced diameter portion of the shank. At least one slot may comprise a tapered geometry. The shank may comprise a bore extending form the distal end to an interface of a bolster and the shank. The bore proximate the interface may comprise a smaller inner diameter than the region of the bore proximate the slot.

A first wall thickness of the bore proximate the tapered portion of the shank may be at least twice as thick as a second wall thickness of the portion of the shank proximate the slot. The bore may have at least one recess formed on an inner diameter of the shank. The pick may have a plurality of slots, at least one of the slots comprising a different width. At least one slot may be forged into the shank. At least one slot may be arranged spirally with respect to the central axis of the shank. The slot may collapse upon insertion into a bore of the holder by one to five percent of the diameter of the shank.

In another aspect of the present invention, at least some portion of the shank may comprise threads. At least some portion of the bore of the pick holder may comprise threads spaced within the bore to threadably connect with the threads of the shank. The slot may collapse upon insertion into a bore of a holder by one to five percent of the diameter of the shank.

In yet another aspect of the invention, a carbide bolster supports a diamond enhanced tip. The tip is bonded to the bolster at a forward end of the bolster and a centralized cavity is formed on a rearward end of the bolster. The rearward end of the bolster is also bonded to a steel shank at a non-planar interface. At least one void is in the interface.

The non-planar interface may be tapered and/or comprise a step. In embodiments with steps, the void may be formed proximate the step.

The void may be located at the center of the interface and a portion of the void may be formed in both the steel shank and the carbide bolster. The portion of the void formed in the steel shank may run through the shank along the shank's central axis to an opening in a rearward end of the shank.

The void may be an annular groove formed in the forward end of the steel shank. The void may also be formed in the rearward end of the carbide bolster. In some embodiments, a first void may be formed at the center of the interface and at least a second void, in the form of an annular groove, may be formed distally to the first void.

The interface may comprise at least one protrusion that controls the thickness of a braze material disposed therein. A bonding material disposed at the interface may be thicker towards a periphery of the interface. The bonding material may comprise 30 to 60 percent palladium.

DETAILED DESCRIPTION

Figure 1:
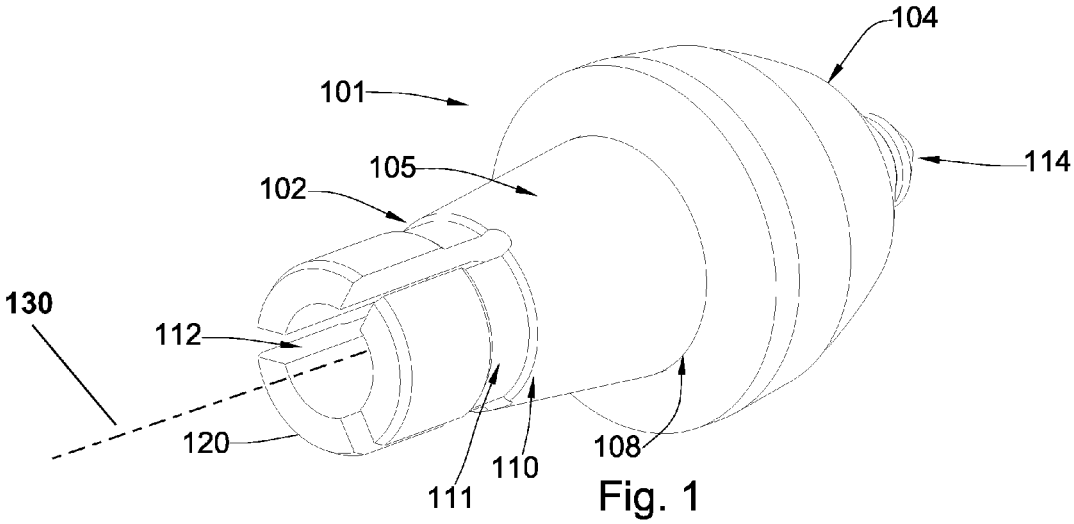
FIG. 1 is a perspective diagram of an embodiment of a pick assembly.

Referring to FIG. 1, a pick assembly 101 includes a shank 102 and a pick head 104 opposite the shank 102. The shank 102 may have a tapered portion 105 proximate the pick head 104. The shank 102 may be tapered at a four to seven degree from the shank's longitudinal axis 130. The tapered portion 105 may have a first end 108 attached to the pick head 104 and a second end 110 connected to a reduced diameter portion 111 of the shank 102. The reduced diameter portion 111 is disposed between the tapered portion 105 and a distal end 120 of the shank 102. The shank 102 may have at least one longitudinal slot 112 extending from the distal end 120 towards the pick head 104. The longitudinal slots 112 may extend from the distal end 120 to the second end 110 of the tapered portion 105. The longitudinal slots 112 may be made by using a band saw, CNC machine, or combinations thereof. At least one longitudinal slot 112 may be formed during forging of the shank 102.

The pick head 104 includes an impact tip 114 attached to a bolster 201. The impact tip 114 may be formed of a super hard material bonded to a carbide substrate at a non-planar interface. The super hard material may include diamond, polycrystalline diamond with a binder concentration of 1 to 40 weight percent, cubic boron nitride, silicon bonded diamond, layered diamond, infiltrated diamond, thermally stable diamond, natural diamond, vapor deposited diamond, physically deposited diamond, monolithic diamond, polished diamond, course diamond, fine diamond, nonmetal catalyzed diamond, cemented metal carbide, chromium, titanium, aluminum, and tungsten.

Figure 2:
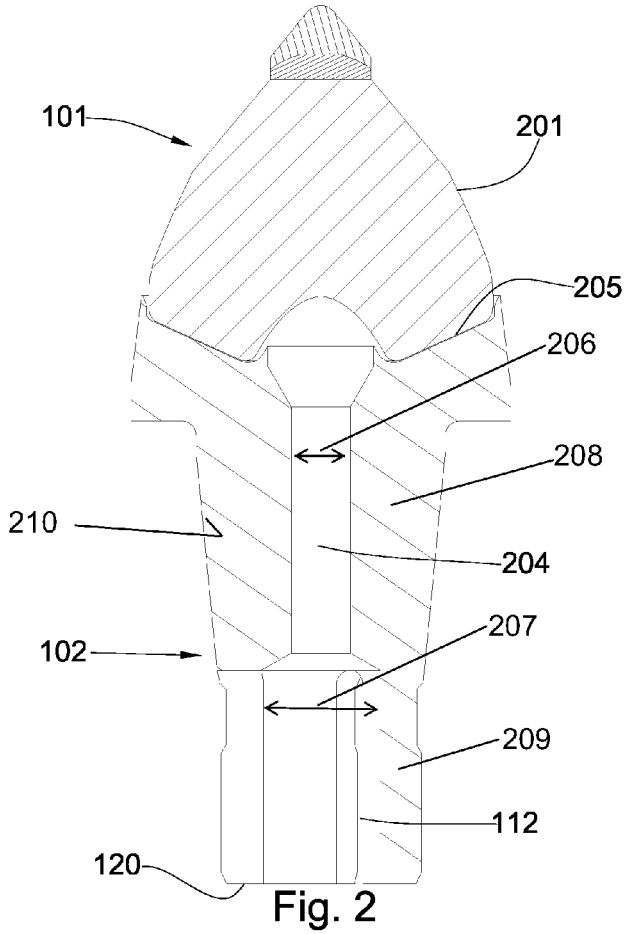
FIG. 2 is a cross-sectional diagram of an embodiment of a pick assembly.

FIG. 2 is a cross-sectional view of the pick assembly 101 of FIG. 1 and discloses a bore 204 extending from the distal end 120 to an interface 205 between the bolster 201 and the shank 102. The bore 204 proximate the interface 205 may have a first inner diameter 206 that is smaller than a second inner diameter 207 of the bore 204 that is proximate the slot 112. The first inner diameter 207 allows a thicker wall 208 at the tapered portion 105 than a thinner wall 209 proximate the distal end 120. The thicker wall 208 may help stabilize the shank 102 and reduce bending moments while the pick assembly 101 is in use. Furthermore, the tapered portion 105 may have more contact surface area between the tapered outer surface 210 of the shank 102 and an inner surface of a pick holder (not illustrated in FIG. 2). The tapered portion 105 may act as a supporting seat. The thinner wall 209 proximate the distal end 120 may allow the shank 102 to resiliently collapse upon insertion of the shank 102 into a bore while still allowing the shank 102 to maintain a press fit while within the bore.

The shank 102 may have a cylindrical geometry. The pick assembly 101 may be manually rotated by removing the pick shank 102 from the holder and reinserting it in the desired orientation. In some embodiments, the pick assembly 101 is rotationally fixed within the holder's bore.

The present invention may allow quick replacement the pick assembly 101. The shank 102 may be press fitted inside a pick holder with an air hammer or similar tools. The distal end 120 may reside within the holder's bore after insertion and during operation. The distal end 120 may have enough lateral spring force to overcome the centrifugal forces of the drum's rotation without requiring any interlocking features.

Figure 3:
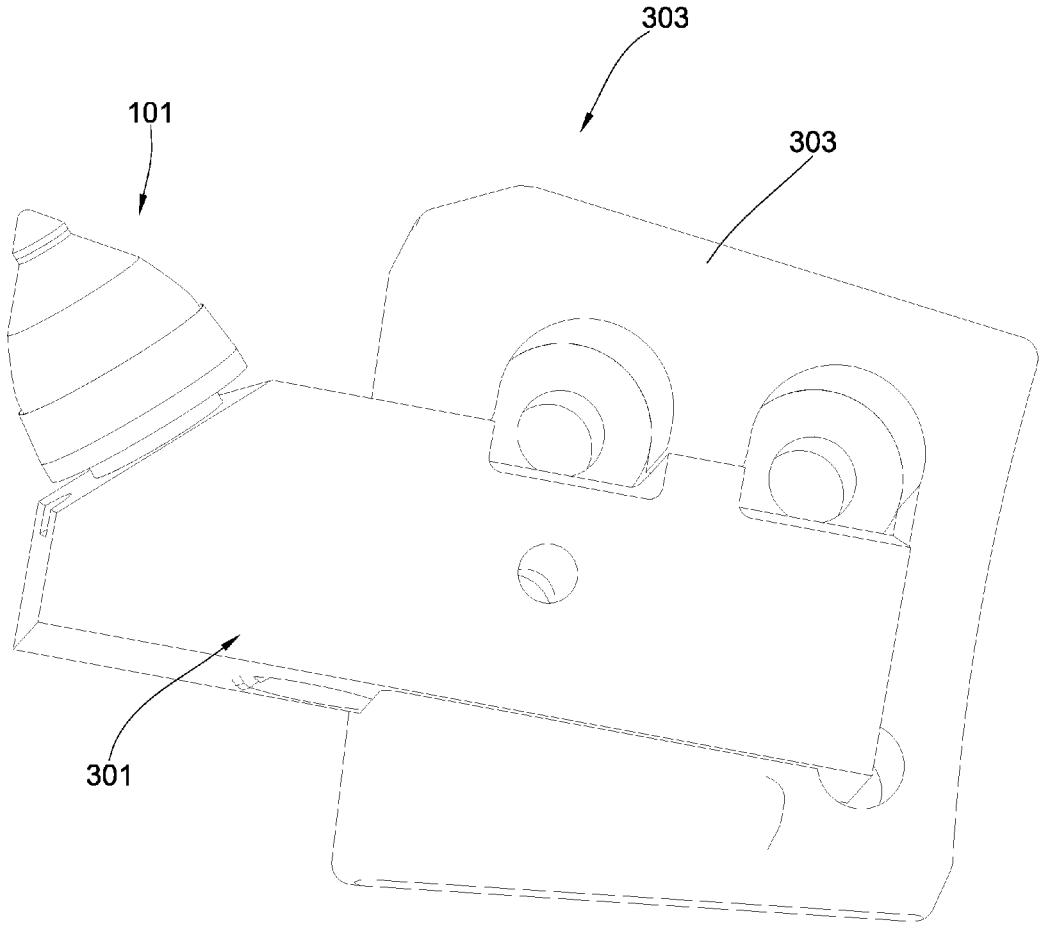
FIG. 3 is a perspective diagram of an embodiment of a holder assembly.

FIG. 3 illustrates the pick assembly 101 of FIGS. 1 and 2 press fitted within an insertable pick holder 301.

Figure 4:
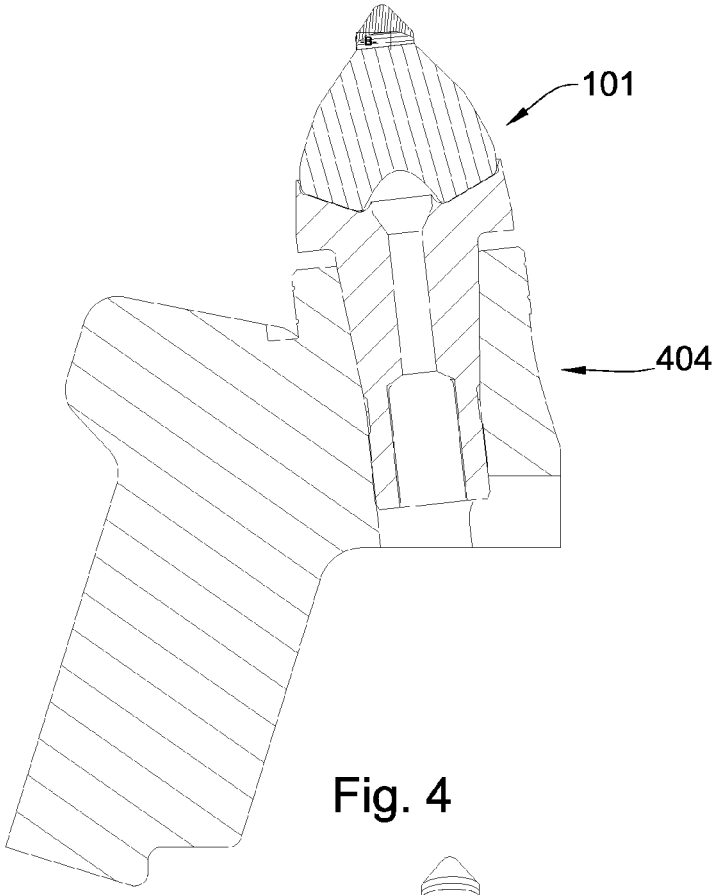
FIG. 4 is a cross-sectional diagram of another embodiment of a holder assembly.
Figure 5:
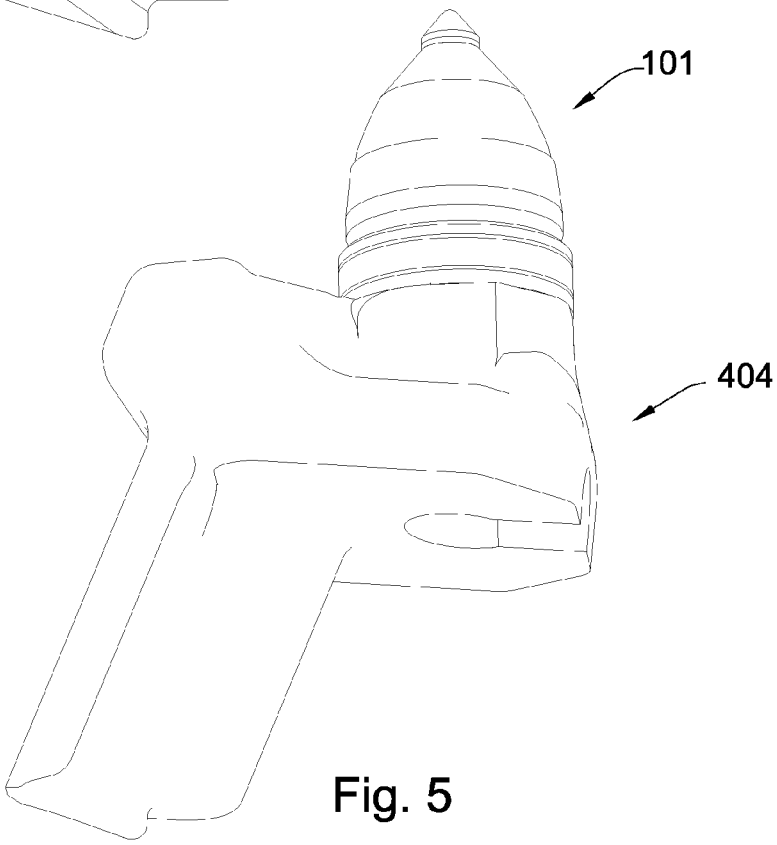
FIG. 5 is a perspective diagram on another embodiment of a holder assembly.

FIGS. 4 and 5 are a cross-sectional and a perspective diagram, respectively, of another embodiment of a holder assembly 404 having the pick assembly 101 press fit therein.

Figure 6:
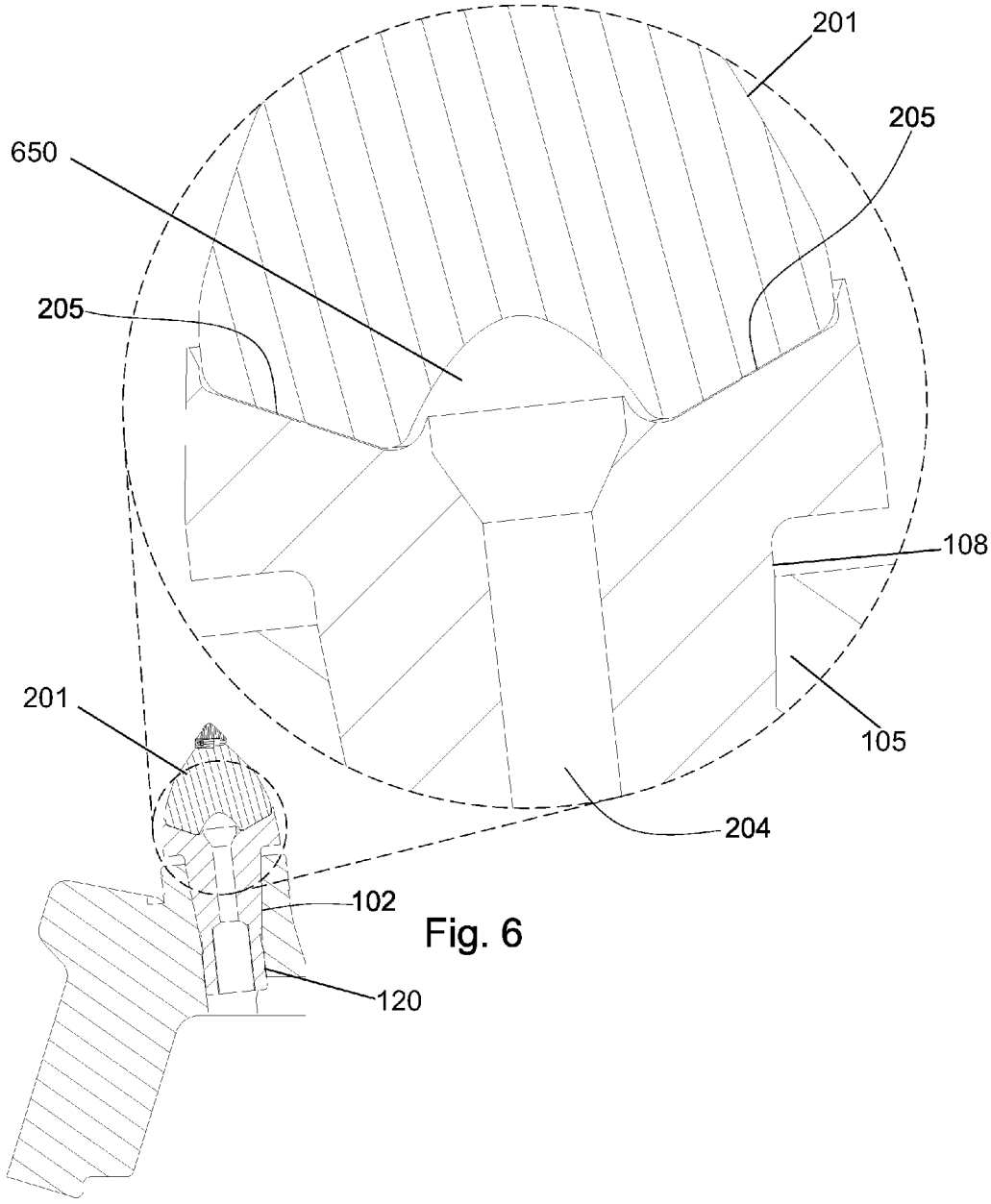
FIG. 6 is a cross-sectional diagram of an embodiment of a pick assembly and a close-up view.

FIG. 6 illustrates a cross section of the holder assembly 404 having the pick assembly 101 press fit therein. The shank 102 includes the bore 204 extending from the distal end 120 to the non-planar interface 205. Heated gases may be emitted while brazing the bolster 201 to the shank 102, which may interfere with bonding. These gases may escape through the bore 204. In some embodiments, the bore 204 may extend from the distal end 120 to the second end 108 of the tapered portion 105.

Figure 7:
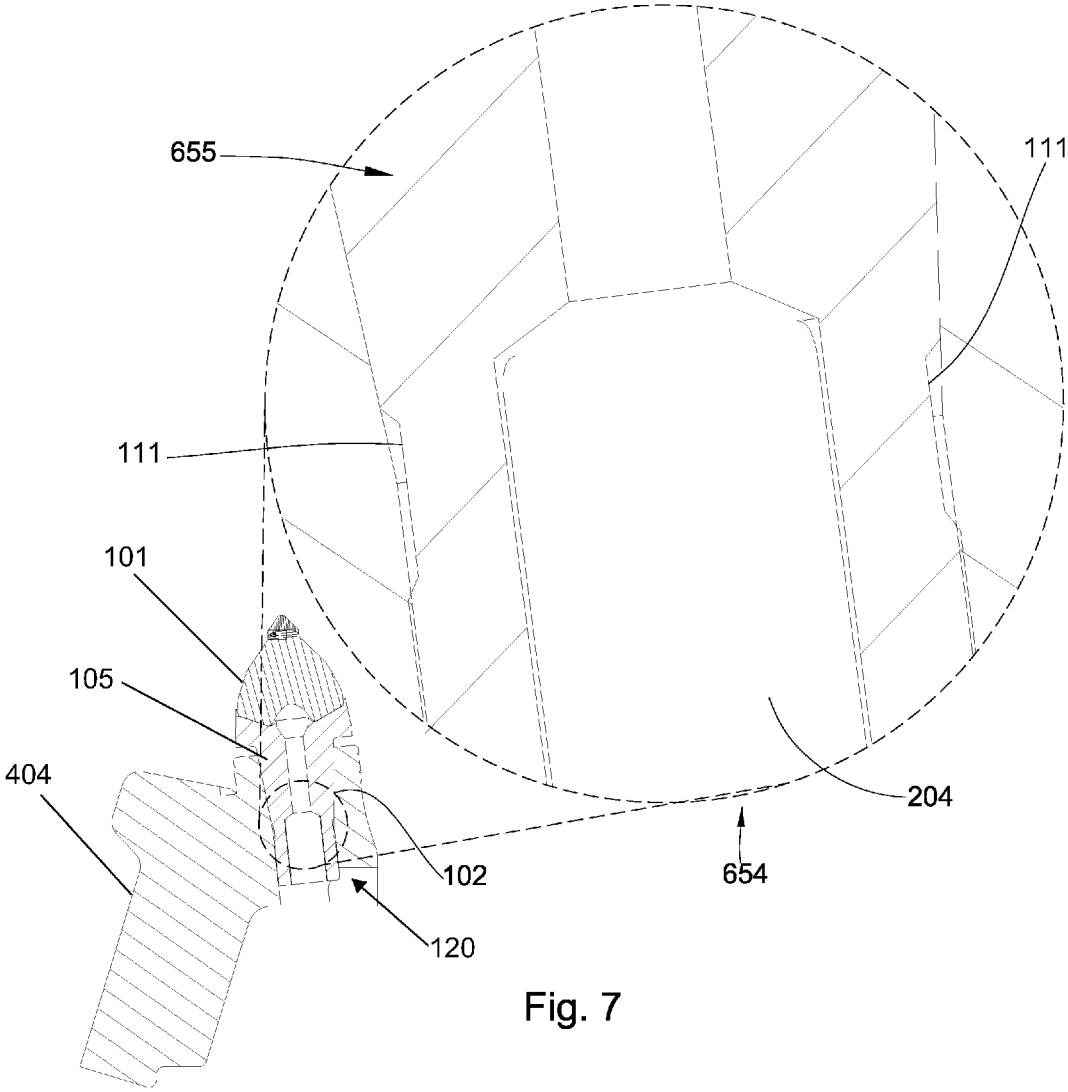
FIG. 7 is a cross-sectional diagram of an embodiment of a pick assembly and a close-up view.

FIG. 7 illustrates a close up, cross section view of the distal end 120 of the shank 102 in the holder assembly 404 having the pick assembly 101 press fit therein. The shank 102 has the reduced outer diameter portion 111 disposed between the tapered portion 105 and the distal end 120. The reduced diameter portion 111 may allow more resilience in the shank 102 proximate the slots 112.

Figure 7A:
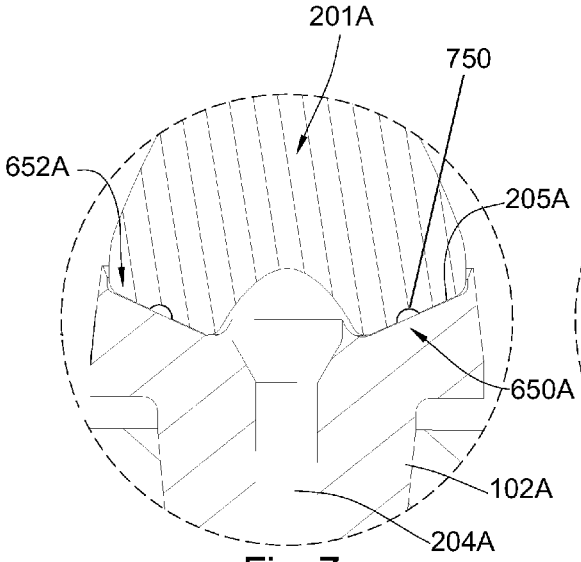
FIG. 7*a* is a close-up view of a cross-sectional diagram of an embodiment of a pick assembly.

FIG. 7*a* illustrates a close-up view of a non-planar interface 205A with a void 650A or interruption formed therein. The void 650A or interruption may provide stress relief after a bonding process. Carbide and steel thermally expand and shrink at different rates during bonding processes resulting in residual stress at the interface 205A. The void 650A reduces stress. In some embodiments, the void 650A will also provide a space 750 for gases let off during the bonding process as well as extra bonding material.

Figure 7B:
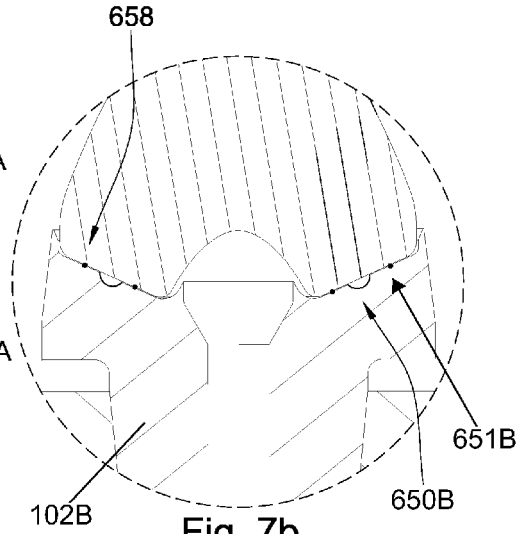
FIG. 7*b* is a close-up view of cross-sectional diagram of an embodiment of a pick assembly.
Figure 7C:
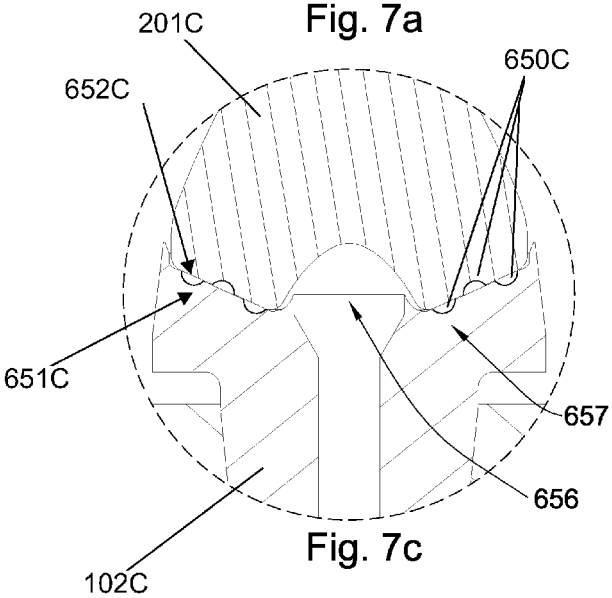
FIG. 7*c* is a close-up view of cross-sectional diagram of an embodiment of a pick assembly.
Figure 7D:
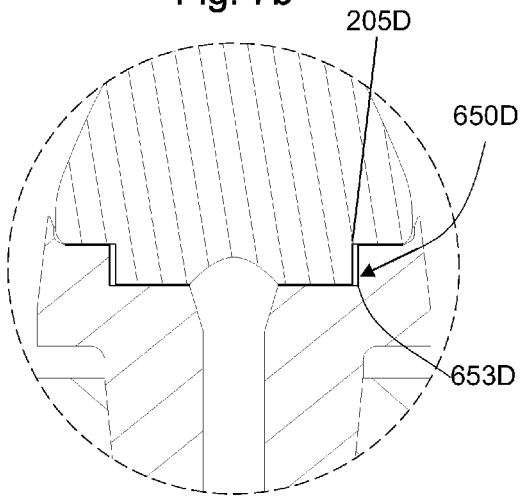
FIG. 7*d* is a close-up view of cross-sectional diagram of an embodiment of a pick assembly.

In FIG. 7*a*, the void 650A is formed in a rearward end 652A of a carbide bolster 201A. In some embodiments, the void 650A is in the form of an annular groove. In FIG. 7*b* a void 650B is formed in the forward end 65B1 of a steel shank 102B. In FIG. 7*c*, a plurality of voids 650C are formed in both a forward end 651C of a shank 102C and a rearward end 652C of a carbide bolster 201C. The void may be formed along a tapered portion of the interface as shown in FIGS. 7*a-c*. In some embodiments, a void 650D is formed proximate a step 653D of the interface 205D as shown in FIG. 7*d*.

In the embodiment of FIG. 6, a void 650 is formed at a center of the interface 205 between the bolster 201 and the shank 102. A portion of the void 650 may be the bore 204 formed in the shank 102 that runs to an opening 654 in the distal end 120 (see FIG. 7) of the shank 102. In the embodiment of FIG. 7C, the plurality of voids 650C and the void at the center may be used in conjunction.

As shown in FIG. 7*b*, a protrusion 658 may be formed in either the bolster 201C or the shank 102B to provide a space between them. This space may determine the bonding material's thickness along the interface 205B. Preferably, the bonding material is thicker towards a periphery of the interface 205B to accommodate stress propagating down the pick's side during impacts. Also, the bonding material may comprise 30 to 60 percent palladium.

Figure 8:
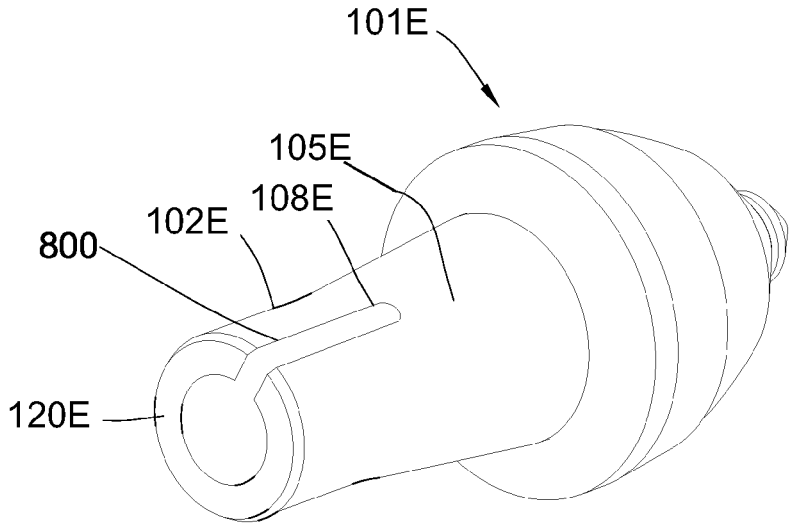
FIG. 8 is a perspective diagram of another embodiment of a pick assembly.

FIG. 8 illustrates a pick assembly 101E having a slot 800 extending from a distal end 120E of a shank 102E to a second end 108E of a tapered portion 105E. The embodiment of FIG. 8 lacks the reduced diameter portion 702 of FIG. 7 between the tapered portion 105E and the distal end 120E.

Figure 9:
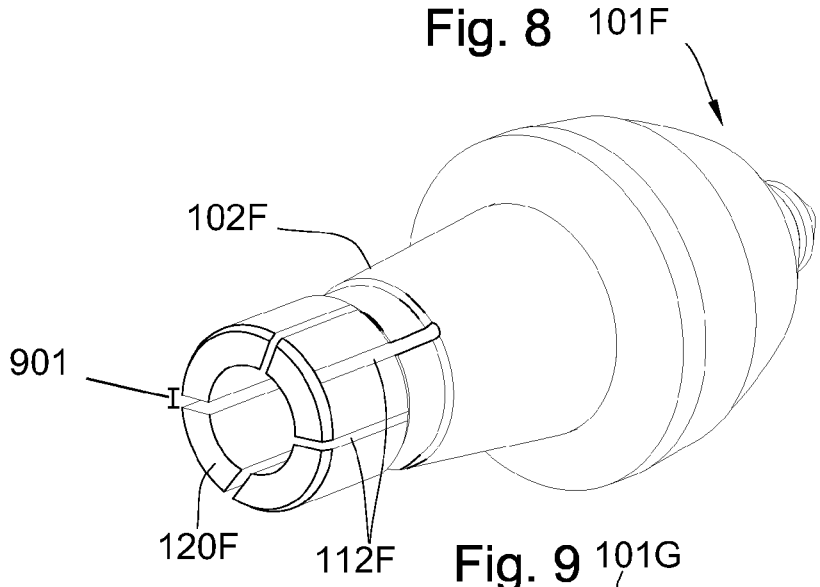
FIG. 9 is a perspective diagram of another embodiment of a pick assembly.

FIG. 9 illustrates a pick assembly 101F having a plurality of slots 112F. Some slots 112F may extend to a distal end 120F while some slots 112F extend only proximate the distal end 120F. A width 901 of each slot 112 may decrease as the number of slots 112 increases. In some embodiments, the slots are different widths.

Figure 10:
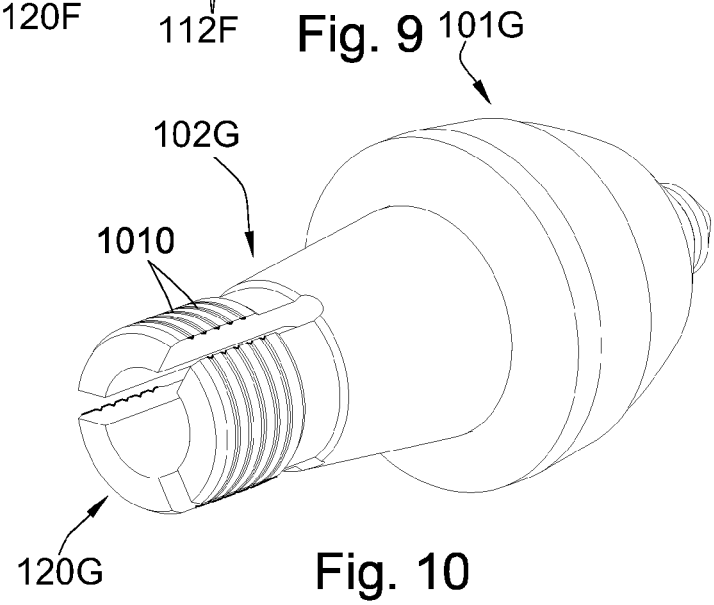
FIG. 10 is a perspective diagram of another embodiment of a pick assembly.

FIG. 10 illustrates a pick assembly 101G having threads 1010 on a distal end 120G of a shank 102G. The shank 102G may be inserted into the holder's bore by turning the pick assembly 101G with a wrench or similar tool. The shank 102G may resiliently collapse as the parts are threaded together. The holder's bore may have internal threads to connect with the threads 1010 on the shank 102G.

Figure 11:
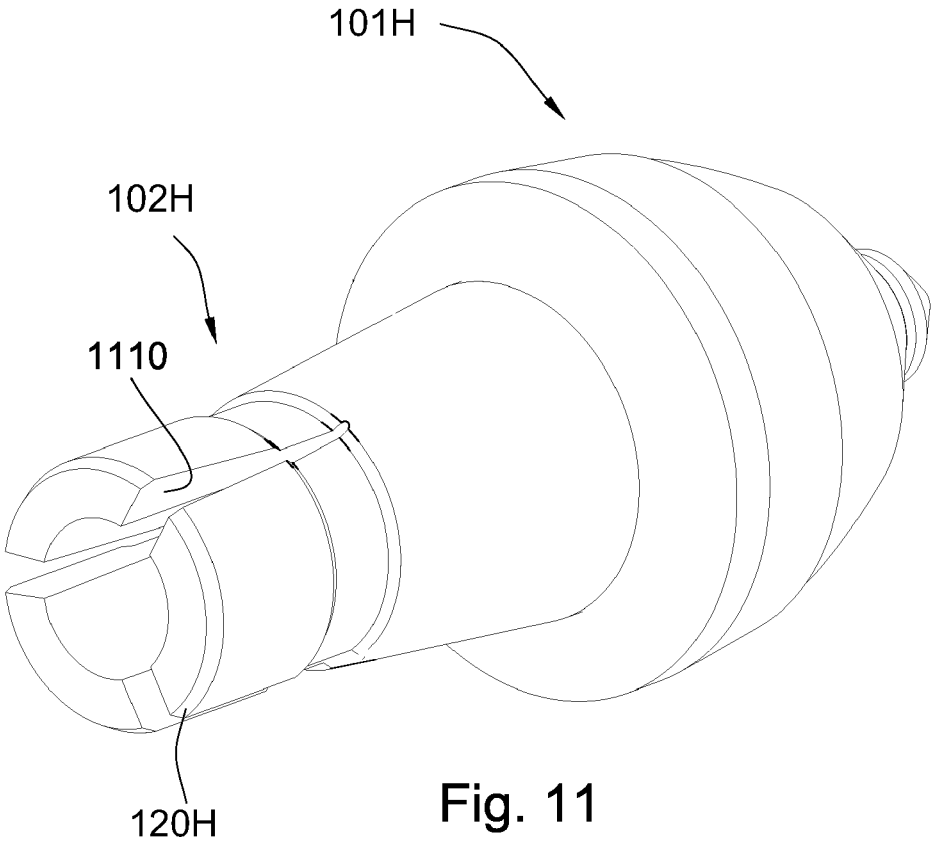
FIG. 11 is a perspective diagram of another embodiment of a pick assembly.

FIG. 11 illustrates a pick assembly 101H having tapered slots 1110 on a distal end 120H of a shank 102H. The tapering may increase outwardly as the taper extends towards the distal end 120H. Such tapering may allow more flexibility to the portion of the shank 102H proximate the distal end 120H.

Figure 12:
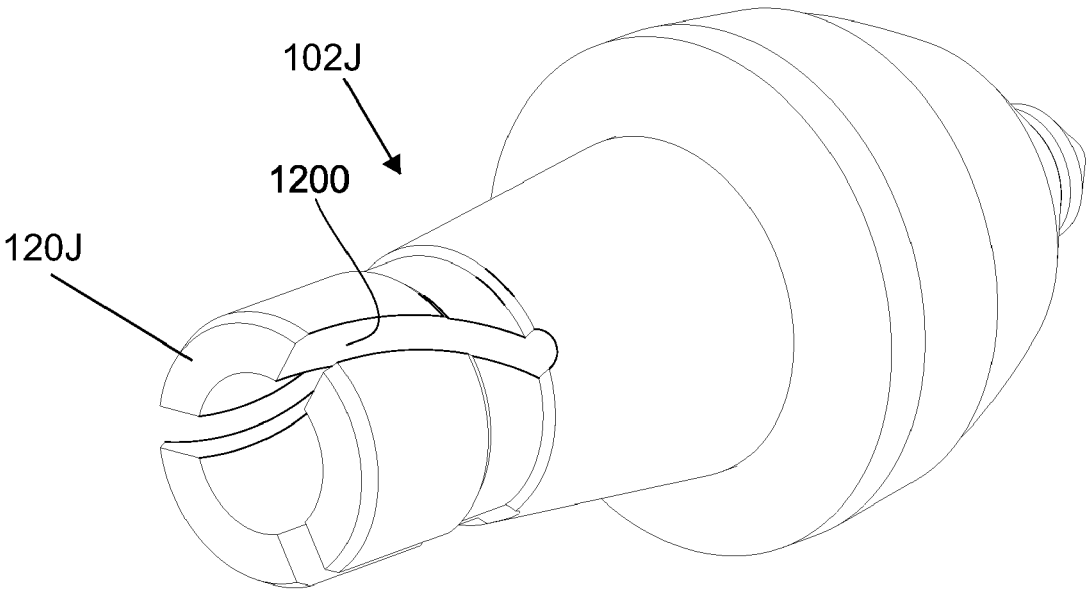
FIG. 12 is a perspective diagram of another embodiment of a pick assembly.

FIG. 12 illustrates slots 1200 arranged spirally with respect to a center of a shank 102J. The embodiment of FIG. 12 may allow more flexibility to a portion of the shank 102J proximate a distal end 120J.

Figure 13A:
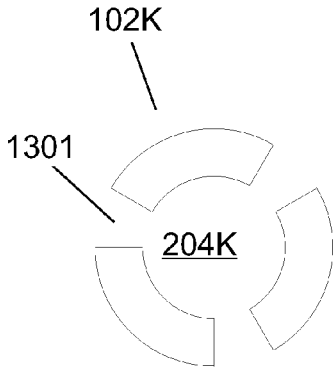
FIG. 13*a* is an orthogonal diagram of an embodiment of a pick shank.
Figure 13B:
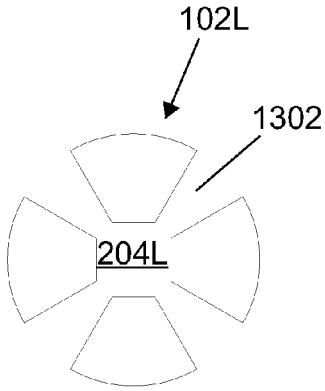
FIG. 13*b* is an orthogonal diagram of another embodiment of a pick shank.
Figure 13C:
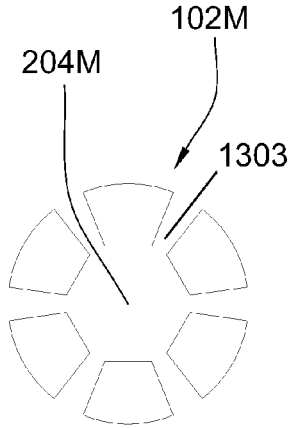
FIG. 13*c* is an orthogonal diagram of another embodiment of a pick shank.
Figure 13D:
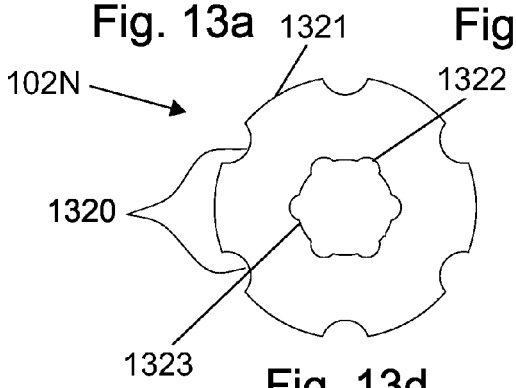
FIG. 13*d* is an orthogonal diagram of another embodiment of a pick shank.
Figure 13E:
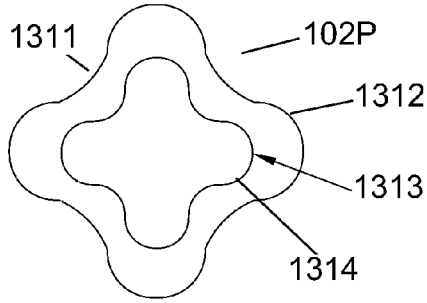
FIG. 13*e* is an orthogonal diagram of another embodiment of a pick shank.

FIGS. 13*a-e* illustrate different cross sections of shanks proximate a distal end. FIG. 13*a* illustrates a shank 102K having 3 slots 1301 and a circular bore 204K. FIG. 13*b* illustrates a shank 102L having 4 wedge shaped slots 1302 and a bore 204L resembling a square. FIG. 13*c* illustrates a shank 102M having 6 slots 1303 and a hexagonal bore 204M. FIG. 13*d* illustrates a shank 102N with recesses 1320 formed on an outer surface 1321 of the shank 102N and recesses 1322 formed on an inner surface 1323 of the shank. FIG. 13*e* illustrates a shank 102P with four recesses 1311 formed on an outer surface 1312 of the shank 102P and recesses 1313 formed on an inner surface 1314 of the shank 102P.

Figure 14:
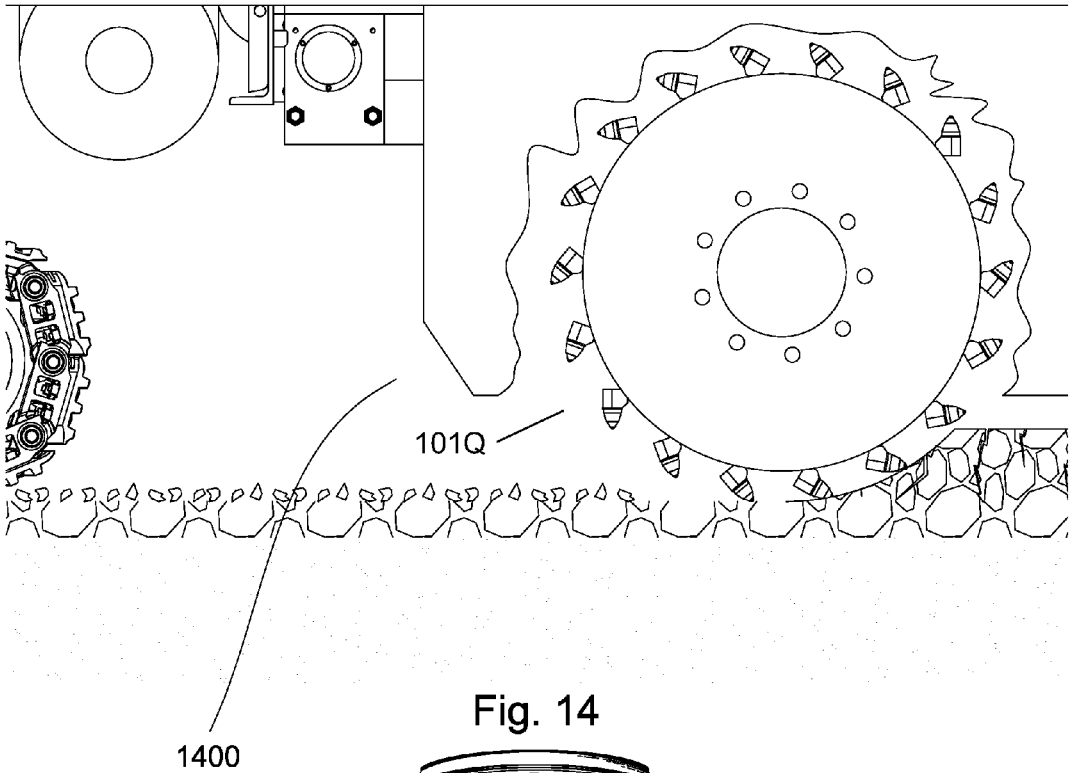
FIG. 14 is a cross-sectional diagram of an embodiment of an asphalt milling machine.

Embodiments of a pick assembly may be used in many different applications. Pick assembly 101Q may be a pick in an asphalt milling machine 1400, as in the embodiment of FIG. 14.

Figure 15:
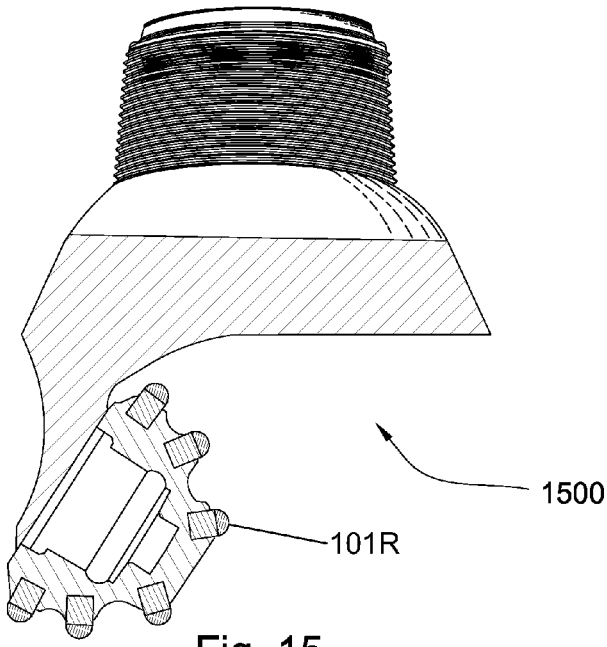
FIG. 15 is a cross-sectional diagram of an embodiment of a roller cone bit.
Figure 16:
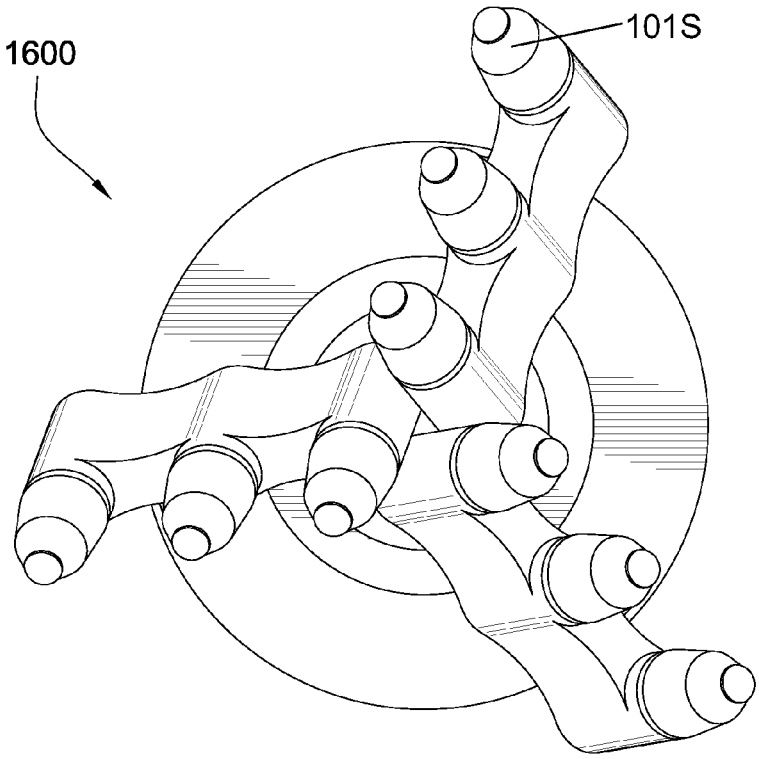
FIG. 16 is an orthogonal diagram of an embodiment of a mining pick.
Figure 17:
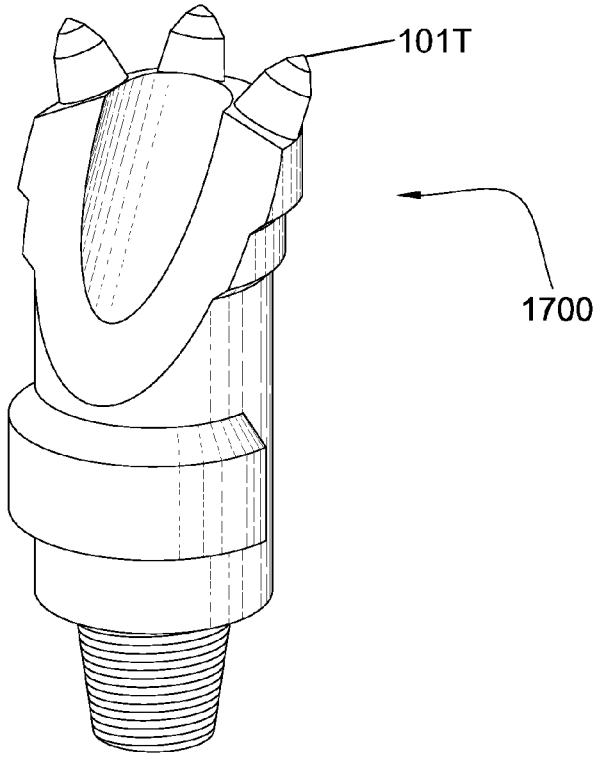
FIG. 17 is a perspective diagram of an embodiment of a drill bit.

A pick assembly 101R may be an insert in a drill bit, as in the embodiments of FIGS. 15-17. As illustrated in FIG. 15, pick assembly 101R may be useful in roller cone bits 1500, where inserts typically fail the formation through compression. In some embodiments, pick assemblies may be angled to enlarge the gauge well bore. FIG. 16 discloses a mining bit 1600 having a pick assembly 101S. FIG. 17 discloses a drill bit 1700 having a pick assembly 101T typically used in horizontal drilling.

Figure 18:
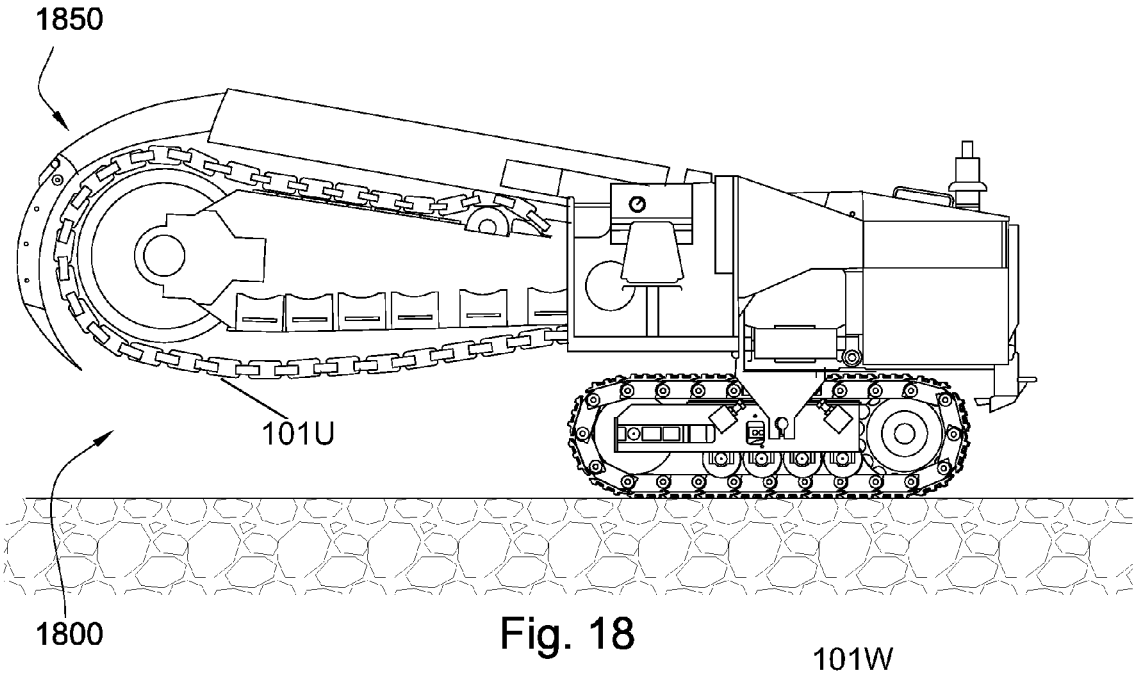
FIG. 18 is an orthogonal diagram of another embodiment of a trenching machine.

FIG. 18 illustrates an embodiment where a pick assembly 101U may be used in a trenching machine 1800. The pick assemblies 101U may be placed on a chain that rotates around a boom 1850.

Crushing or degradation machines may also incorporate the present invention. The crushing or degradation machines may be used for size reduction in materials such as rocks, grain, trash, natural resources, chalk, wood, tires, metal, cars, tables, couches, coal, minerals, and chemicals.

Figure 19:
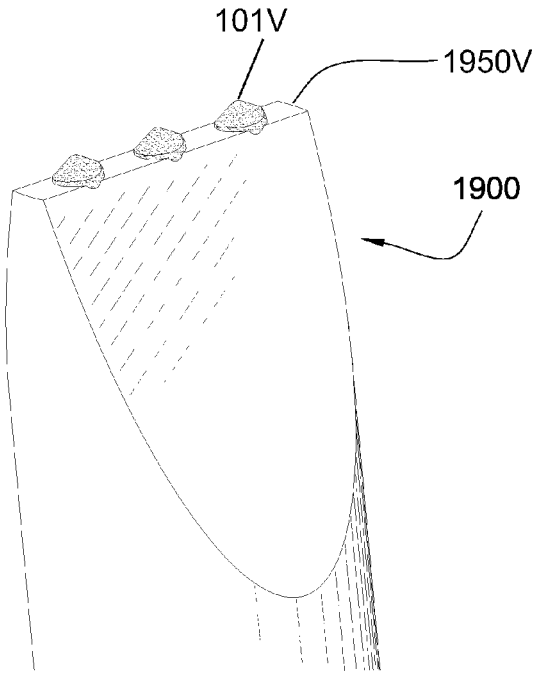
FIG. 19 is a perspective diagram of an embodiment of a chisel.
Figure 20:
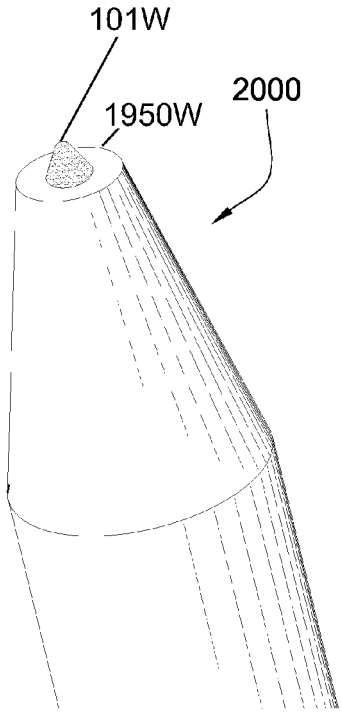
FIG. 20 is a perspective diagram of another embodiment of a moil.

As shown in FIG. 18, chisels 1900 may also incorporate a pick assembly 101V on an impacting end 1950V. In the embodiment of FIG. 19, pick assembly 101W is located on an impacting end 1950W of a moil 2000.

Figure 21:
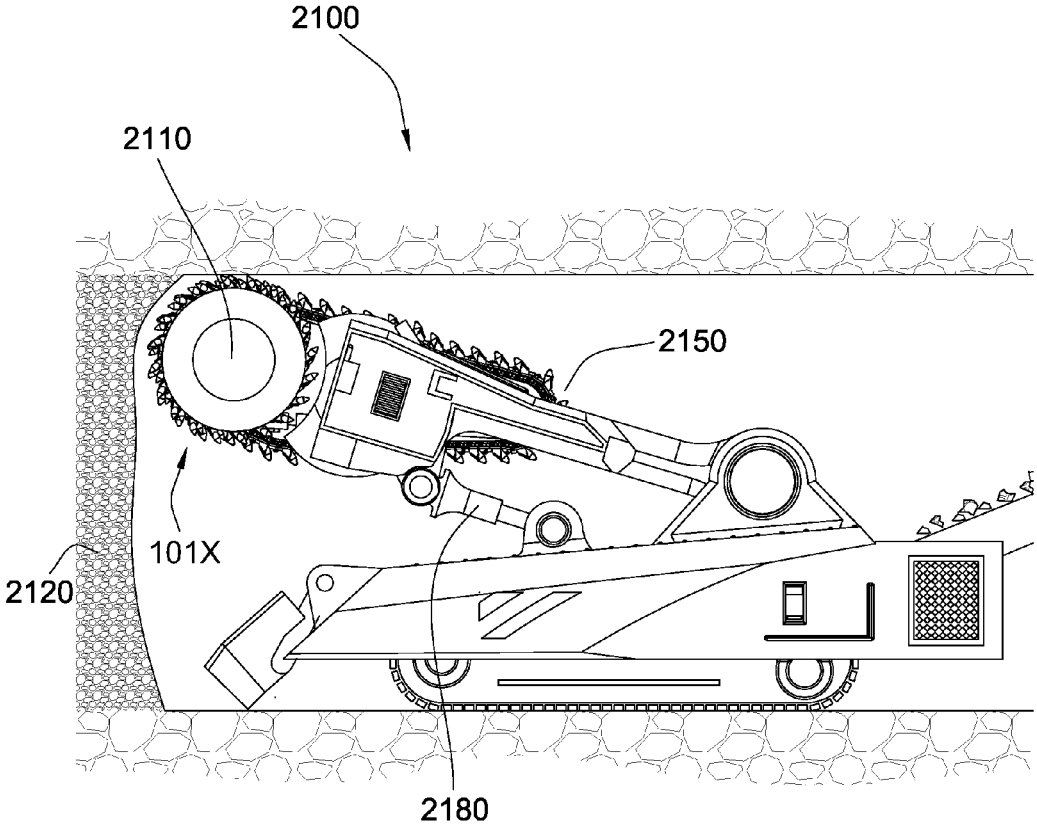
FIG. 21 is an orthogonal diagram of an embodiment of a coal excavator.

FIG. 21 discloses a mining machine 2100. Pick assemblies 101X may be connected to a rotating drum 2110 while degrading mineral or coal formations 2120. The rotating drum 2110 is connected to an arm 2150 that moves the drum 2110 vertically in order to engage the formation 2120. The arm 2150 may move by a hydraulic arm 2180, which may also pivot about an axis. The mining machine 2100 may move about by tracks, wheels, or a combination thereof. The mining machine 2100 may also move about in a subterranean formation.

Whereas the present invention has been described in particular relation to the drawings attached hereto, it should be understood that other and further modifications apart from those shown or suggested herein, may be made within the scope and spirit of the present invention.

What is claimed is:

1. A pick assembly comprising:

a pick having a shank with a distal end and a proximal end spaced apart from said distal end, said pick having a pick head disposed at said proximal end of said shank, said shank having a bore extending from said distal end to said proximal end, said bore having a first portion with a first inner diameter at said distal end and a second portion having a second inner diameter proximate said proximal end, said second inner diameter being less than said first inner diameter, and at least one longitudinal slot extending from said distal end toward said proximal end; and a holder having a holder bore disposed therein, said holder bore sized and shaped to receive said shank.

2. The pick assembly of claim 1, wherein the shank has a tapered portion proximate said pick head.

3. The pick assembly of claim 2, wherein the shank has a reduced outer diameter portion disposed between said tapered portion and said distal end.

4. The pick assembly of claim 2 wherein said tapered portion has a first tapered end at said proximal end and a second tapered end spaced apart from said first tapered end, wherein said slot extends to from said distal end of the shank to said second tapered end.

5. The pick assembly of claim 3, wherein said tapered portion extends distally from said proximal end of said shank to said reduced outer diameter portion of said shank.

6. The pick assembly of claim 2, wherein an a first outer surface area of said tapered portion is greater than a second surface area of said shank extending between said distal end and said tapered portion.

7. The pick assembly of claim 1, wherein a longitudinal slot has a first slot width at said distal end and a second slot width proximate said tapered portion, said second slot width being less than said first slot width.

8. The pick assembly of claim 1, wherein said bore includes a tapered portion connecting said first portion and said second portion.

9. The pick assembly of claim 1, wherein the bore proximate the pickhead has an outwardly tapered transition from said second portion.

10. The pick assembly of claim 1, wherein said shank has a wall defined by an outer surface of said shank and said bore, wherein said tapered portion has a varying wall thickness and said first portion has a wall thickness and wherein said varying wall thickness is at least twice as great as said wall thickness.

11. The pick assembly of claim 1, wherein said holder bore has at least one recess formed on an inner wall of said holder bore.

12. The pick assembly of claim 1, wherein said pick has a plurality of said longitudinal slots and at least one of said longitudinal slots has a width different from a width of a second longitudinal slot.

13. The pick assembly of claim 1, wherein a longitudinal slot is forged into said shank.

14. The pick assembly of claim 1, wherein a longitudinal slot is is arranged spirally with respect to a central axis of the shank.

15. The pick assembly of claim 1, wherein said thank has a first threaded portion with an external thread.

16. The pick assembly of claim 15, wherein said holder bore has a second threaded portion with an internal thread sized and shaped to threadably connect with said external thread.

17. The pick assembly of claim 1, wherein said slot has a first width when said pick is unassembled and a second width when said pick is inserted into said holder bore, said second width being less than said first width by one to five percent of an outer diameter of the shank.

18. The pick assembly of claim 1, wherein said pick head has an impact tip comprising a super hard material.

19. A pick for use in a degradation assembly, the pick comprising:

a shank with a distal end and a proximal end spaced apart from said distal end; and a pick head disposed at said proximal end of said shank;

a bore extending from said distal end to said proximal end, said bore having a first portion with a first inner diameter at said distal end and a second portion having a second inner diameter proximate said proximal end, said second inner diameter being less than said first inner diameter; and at least one longitudinal slot extending from said distal end toward said proximal end.

20. The pick of claim 19, wherein said shank has a wall defined by an outer surface of said shank and said bore, wherein said shank has a first wall thickness at said distal end and a second wall thickness at said proximal end, said second wall thickness greater than said first wall thickness.

* * * * *